United States Patent [19]

Vilen et al.

[11] 3,931,013

[45] Jan. 6, 1976

[54] WATER SEPARATOR-RECIRCULATOR FOR DISHWASHING MACHINE

[75] Inventors: Erik O. Vilen, La Grange Park; Vytas Zygas, Cicero, both of Ill.

[73] Assignee: G. S. Balkeslee & Co., Cicero, Ill.

[22] Filed: Aug. 30, 1974

[21] Appl. No.: 501,889

[52] U.S. Cl. ..... 210/152; 210/297; 210/389

[51] Int. Cl.[2] ..... B01D 33/22

[58] Field of Search ..... 210/152, 297, 388, 389, 210/408, 414, 158, 159, 167; 209/337, 342, 269

[56] References Cited

UNITED STATES PATENTS

| | | | |
|---|---|---|---|
| 1,521,469 | 12/1924 | Pawlikowski | 209/269 |
| 2,308,264 | 1/1943 | Bolton | 210/389 X |
| 2,439,543 | 4/1948 | Ketchum | 210/389 |
| 3,231,088 | 1/1966 | Grasse | 209/342 X |
| 3,622,508 | 11/1971 | Komline | 210/152 X |

*Primary Examiner*—John Adee

*Attorney, Agent, or Firm*—Johnson, Dienner, Emrich & Wagner

[57] ABSTRACT

A trough, which receives mixed water and waste, has first and second openings in the bottom thereof. Oscillating grid means overlies the first opening, and is associated with stationary wiper means. The grid means allows the water to flow therepast into the first opening, and in conjunction with the wiper means directs the waste into the second opening.

7 Claims, 9 Drawing Figures

Fig. 6.
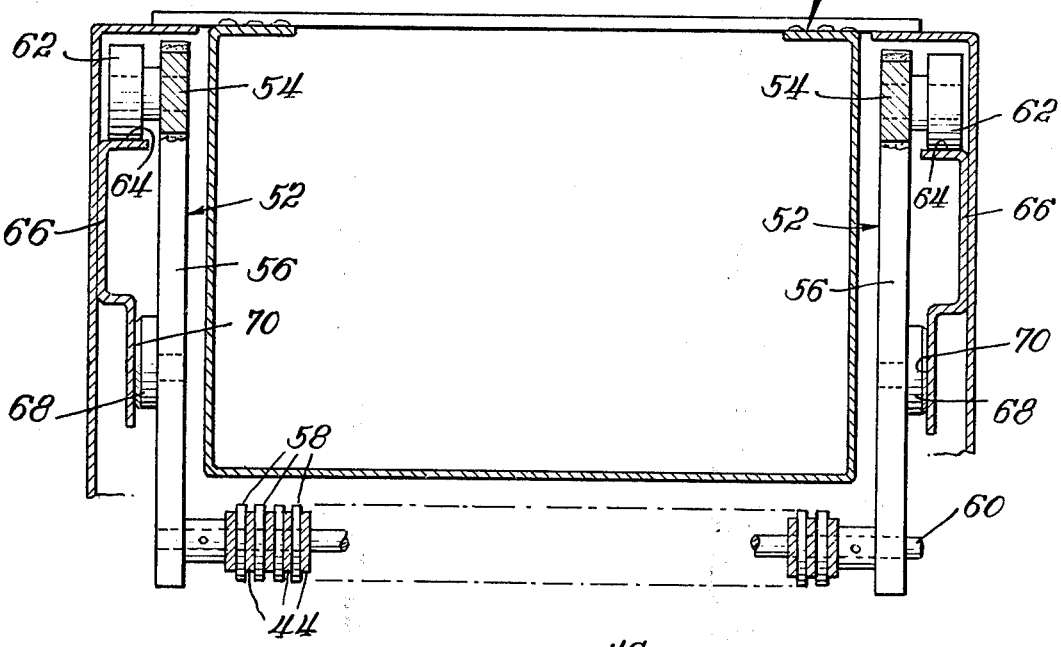
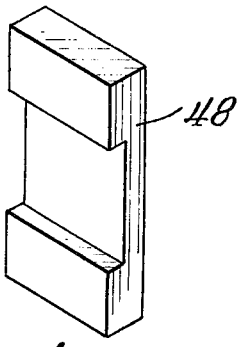
Fig. 9.
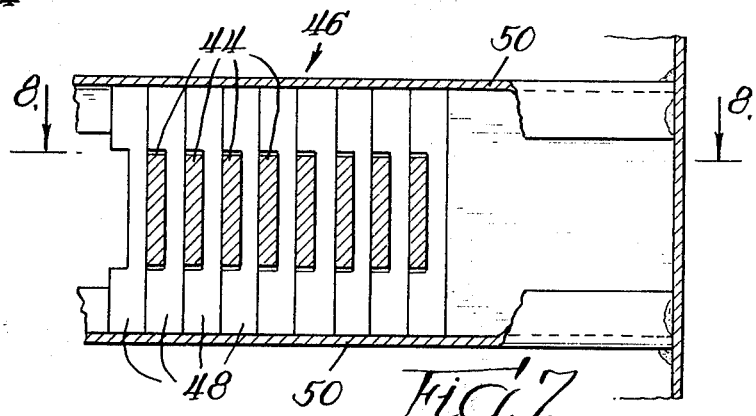
Fig. 7.
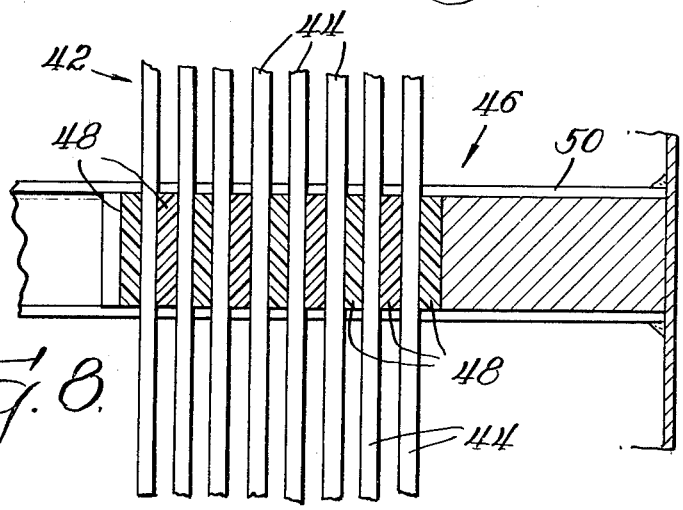
Fig. 8.

WATER SEPARATOR-RECIRCULATOR FOR DISHWASHING MACHINE

FIELD OF THE INVENTION

The present invention relates generally to commercial dishwashing machines, and more particularly to an adjunct water separator-recirculator which receives mixed water and waste from a dishwashing machine and separates the same whereby the water may be recirculated through the dishwashing machine.

SUMMARY OF THE INVENTION

The water-waste separator of the present invention comprises a trough into which mixed water and waste is introduced at one end thereof. The bottom of the trough is formed with a first opening intermediate of the ends thereof, and with a second opening at the other end thereof. Horizontal grid means overlies the first opening and accommodates the flow of water therethrough into the first opening. Stationary wiper means is associated with the grid means along the upstream side of the first opening. Means oscillates the grid means whereby waste collected thereon is cyclically forced by the wiper means over the end of the grid means and is directed into the second opening. The water separated from the waste is available for reuse.

BRIEF DESCRIPTION OF THE DRAWINGS

FIG. 6 is a vertical sectional view, on a further enlarged scale, taken substantially along the line 6—6 in FIG. 3 looking in the direction indicated by the arrows;

FIG. 7 is a partial vertical sectional view, on a further enlarged scale, taken substantially along the line 7—7 in FIG. 3 looking in the direction indicated by the arrows;

FIG. 8 is a horizontal sectional view taken substantially along the line 8—8 in FIG. 7 looking in the direction indicated by the arrows; and FIG. 9 is a perspective view of one of the wiper segments shown in FIGS. 7 and 8.

DESCRIPTION OF THE PREFERRED EMBODIMENT

Figure 1:
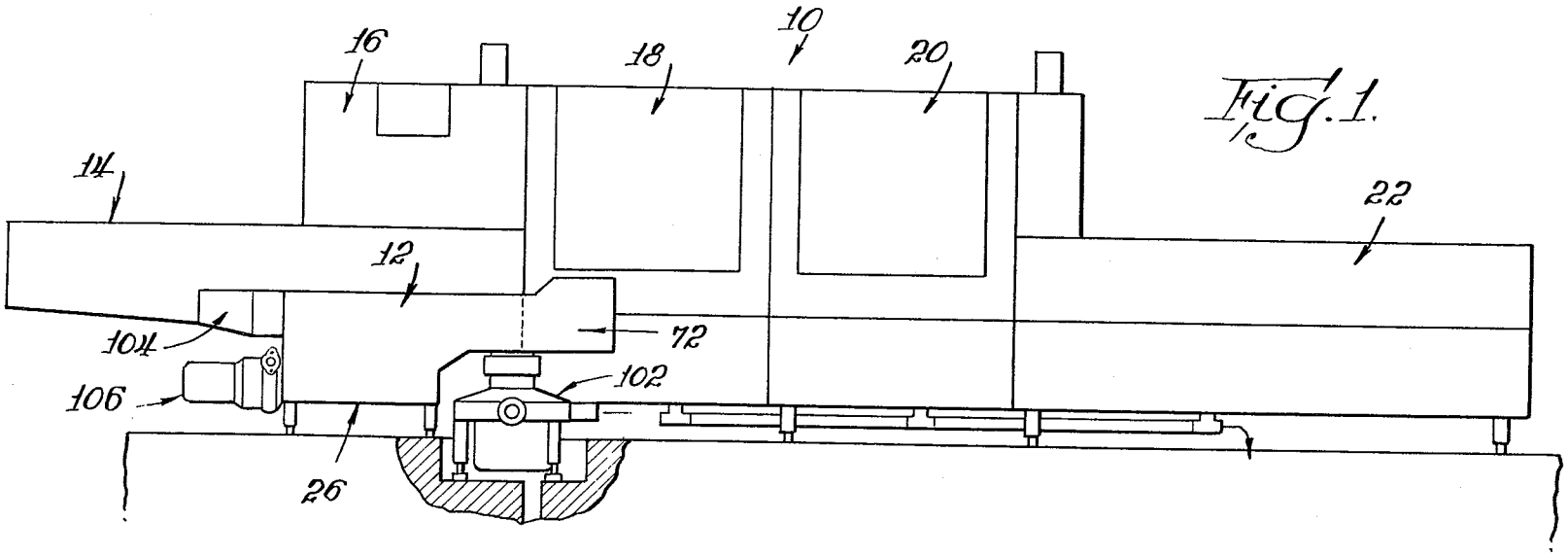
FIG. 1 is a side elevational view of a commercial dishwashing machine with which is associated the water separator-recirculator of the present invention.
Figure 2:
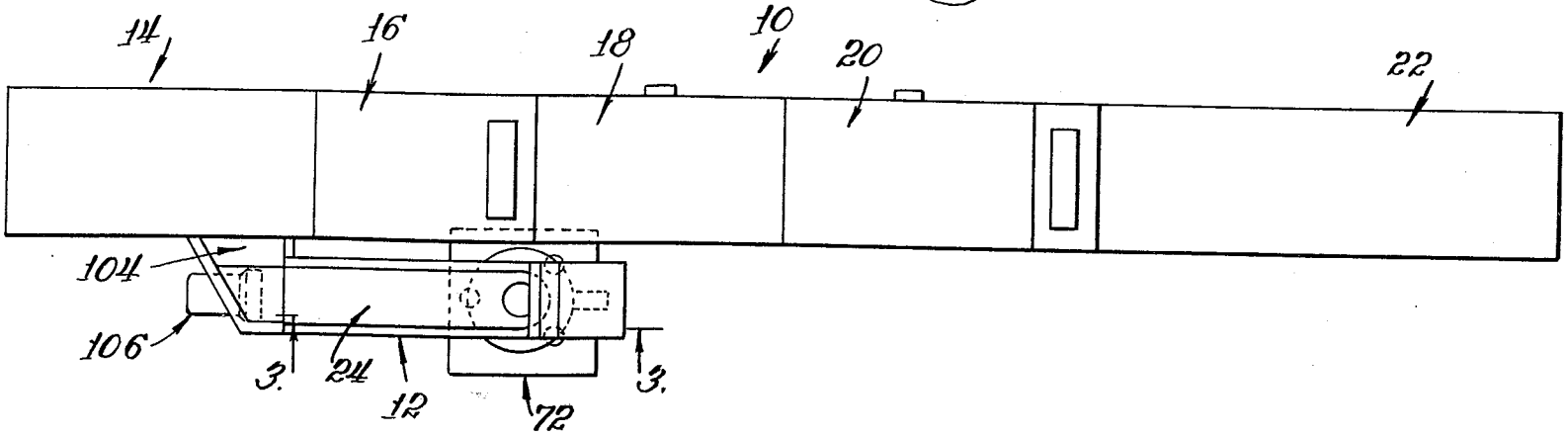
FIG. 2 is a plan view of the dishwashing machine and water separator-recirculator of FIG. 1.

Referring now to FIGS. 1 and 2, there is indicated generally by the reference numeral 10 a conventional flight conveyor type dishwashing machine with which is associated a water separator-recirculator 12 embodying the principles of the present invention.

The dishwashing machine 10 includes an open top load section 14, an open ended preflush housing section 16, an open ended wash housing section 18, an open ended rinse housing section 20, and an open top unload section 22. Extending lengthwise of the machine 10, between the load and unload sections 14 and 22, is a conventional endless conveyor (not shown) which serves to move dishes, trays or other articles through the housing sections 16, 18 and 20. Mounted within the housing sections 16, 18 and 20 are conventional spray boxes (not shown) from which sprays or jets of water or washing solution are projected against the dishes, trays or other articles being moved through the machine 10.

Figure 3:
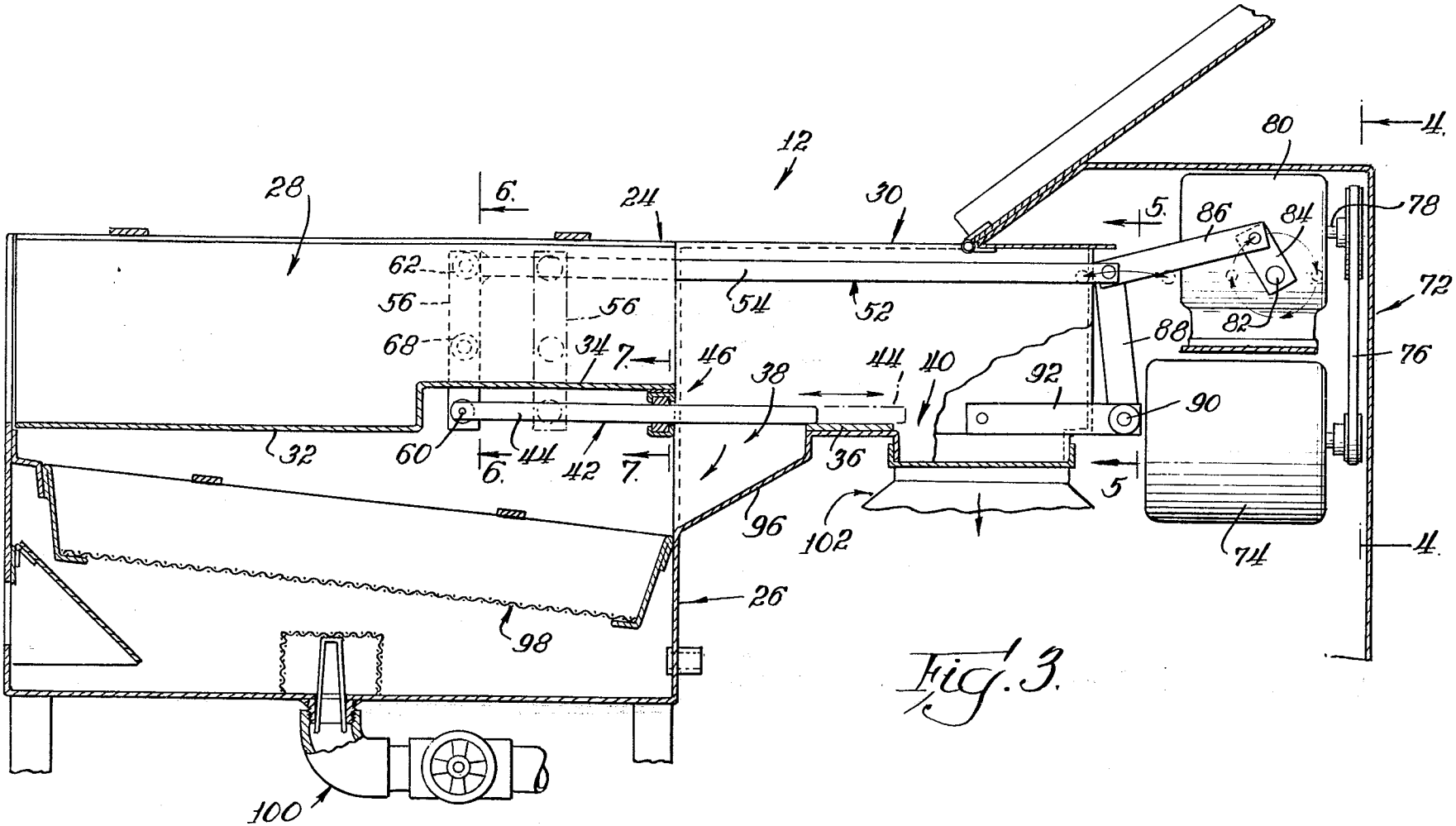
FIG. 3 is a vertical sectional view, on an enlarged scale, taken substantially along the line 3—3 in FIG. 2 looking in the direction indicated by the arrows.

The water separator-recirculator 12, which is located at the side of the machine sections 14 and 16, comprises as shown in FIG. 3, a trough 24 supported on a reservoir tank 26.

The trough includes an upstream section 28 and a downstream section 30. The upstream section 28 has a bottom removable panel 32 formed with an upwardly offset portion 34. The vertical abutment defined by the offset portion 34 serves to stop or block the passage of silverware and the like into the downstream section 30. A transverse web member 36 is secured across the bottom of the downstream section 30 whereby to define separate first and second openings 38 and 40 in the bottom of the section 30 or trough 24.

Overlying the first opening 38, and underlying the bottom offset portion 34, is horizontal grid means 42 comprised of a plurality of laterally spaced apart elongated bars 44. The outer ends of the grid bars 44 are slidably supported on the web member 36. The intermediate portions of the grid bars 44 are slidably supported in stationary wiper means 46 mounted along the upstream side of the first opening 38. The wiper means 46 comprises, as shown in FIGS. 7–9, side-by-side C-shaped plastic wiper segments 48 located in upper and lower channel members 50. The grid means 42 accommodates the flow of water therethrough into the first opening 38.

Means for oscillating the grid means 42, as shown in FIGS. 3 and 6, comprises a pair of generally horizontally movable L-shaped push-pull drive members 52 each having a horizontal leg portion 54 and a vertical leg portion 56. The inner ends of the grid bars 44, separated by washer spacers 58, are mounted on a transverse shaft 60 journaled in the lower ends of the vertical leg portions 56 of the drive members 52. The corner of each drive member 52 is provided with a roller 62 which rides on the horizontal bearing surface 64 of an adjacent side channel 66. Each vertical leg portion 56 is provided with an intermediate slide pad 68 which rides along the vertical bearing surface 70 of the adjacent side channel 66.

Figure 4:
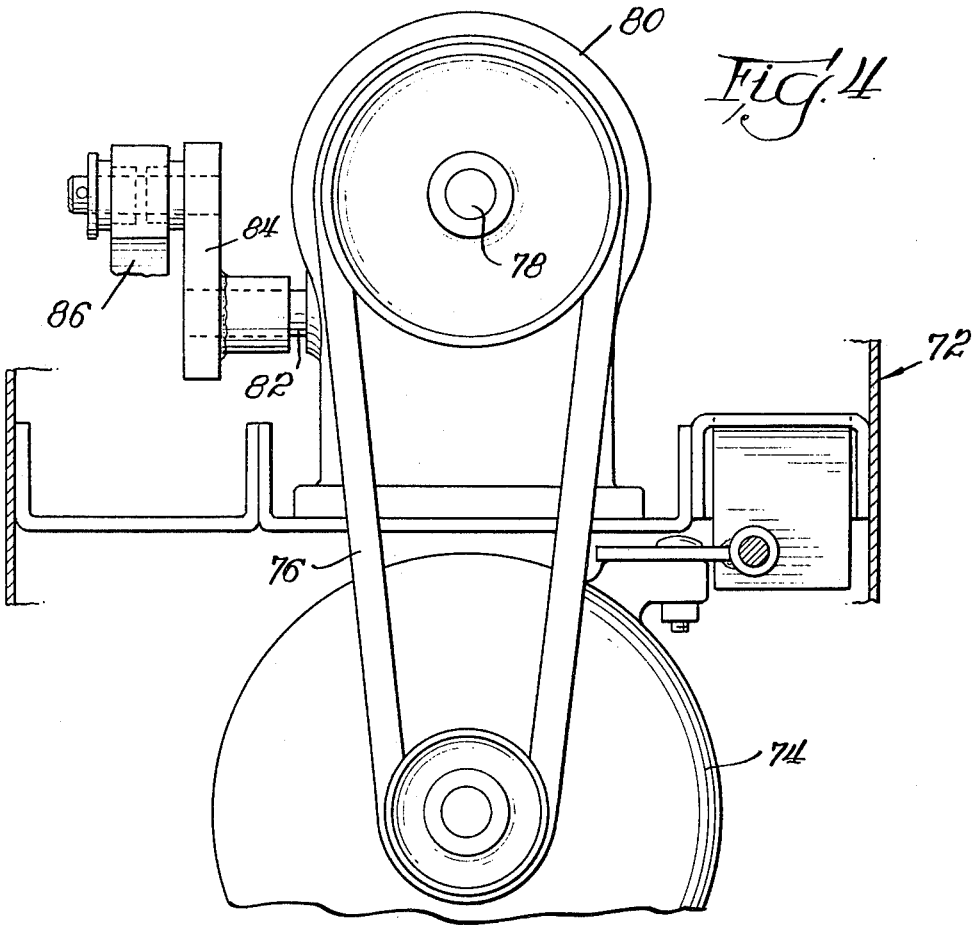
FIG. 4 is a vertical sectional view, on a further enlarged scale, taken substantially along the line 4—4 in FIG. 3 looking in the direction indicated by the arrows.
Figure 5:
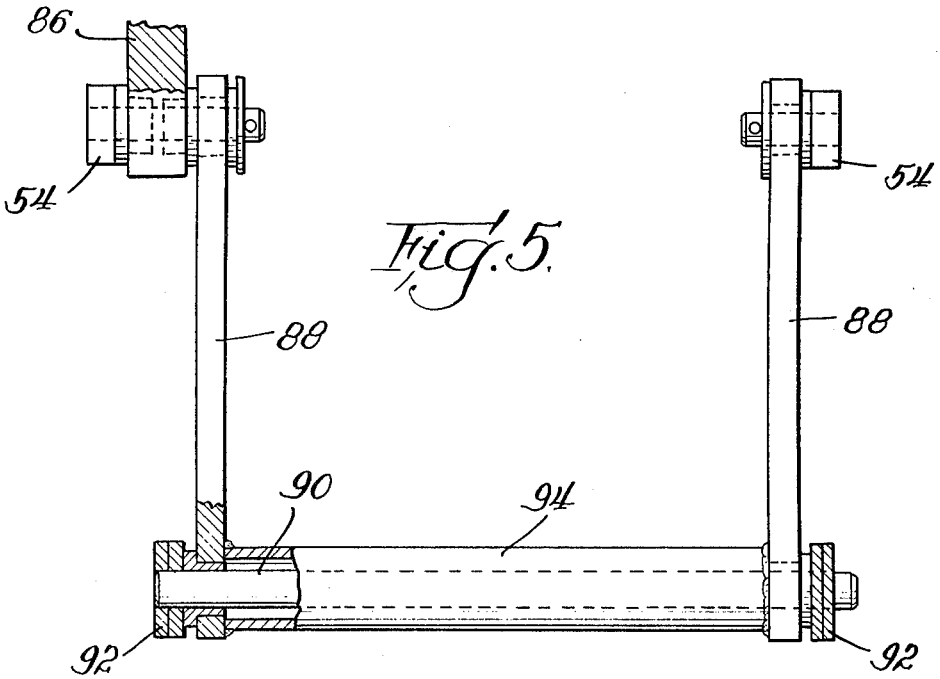
FIG. 5 is a vertical sectional view, on a further enlarged scale, taken substantially along the line 5—5 in FIG. 3 looking in the direction indicated by the arrows.

Drive means for effecting movement of the drive members 52, as shown in FIGS. 3–5, are arranged within a housing 72 mounted at the end of the downstream section 30. The drive means comprises an electric motor 74 connected by a belt 76 to the input shaft 78 of a reduction gear box 80. Secured to the output shaft 82 of the bear box 80 is a crank arm 84. A connecting link 86 is pivotally connected at its one end to the crank arm 84 and at its other end to the end of the horizontal leg portion 54 of the adjacent drive member 52. Also, reaction links 88 are pivotally connected at their one ends to the ends of the horizontal leg portions 54 and at their other ends to a transverse shaft 90 secured in stationary frame elements 92. The reaction links 88 are interconnected by a sleeve member 94 surrounding the shaft 90 which establishes a stationary pivot point.

The crank arm 84 revolves upon energization of the motor 74 and effects generally rectilinear movement of the drive members 52 and concurrent oscillation of the grid means 42. An oscillation rate of about 30 cycles per minute has been found to be satisfactory for purposes of the present invention.

As shown in FIG. 3, conduit means in the form of a channel duct 96 serves to place the first opening 38 in communication with the reservoir tank 26; and the reservoir tank 26 is provided with a removable strainer tray 98 and a conventional manually operable drain assembly 100. As shown in FIGS. 1 and 2, a conventional mechanical waste disposal unit 102 is mounted below the downstream trough section 30 and communicates with the second opening 40. The upstream end of the trough 24 is placed in communication with the lower portion of the load section 14 by a trough extension 104. A conventional motor-pump unit 106, mounted at the end of the reservoir tank 26, draws water from the tank 26 and circulates it to spray boxes located within the preflush section 16 or elsewhere in the machine 10.

As dishes, trays and silverware are being moved through the dishwashing machine 10 from the load section 14 to the unload section 22, a substantial portion of waste food and other foreign material is dislodged from these articles by jets of water in the preflush section 16. The mixed water and waste initially collects in the bottom of the load secion 14, and then travels through the trough extension 104 to the trough 24 where it flows over the offset portion 34 to the oscillating grid means 42. The water passes through the grid means 42, the first opening 38, the channel duct 96 and the strainer tray 98 to the bottom portion of the reservoir tank 26 where it is available for recirculation by the pump 106. The waste initially collects on the oscillating grid means 42.

As the grid means 42 moves to the left from the dotted line position to the solid line position shown in FIG. 3, the waste adjacent the wiper means 46 is pushed or forced by the latter toward the end of the grid means 42 thereby forcing the waste at the end over the end onto the web member 36. Then as the grid means 42 moves to the right from the solid line position to the dotted line position shown in FIG. 3, the waste on the web member 36 is forced by the end of the grid means 42 into the second opening 40 where it falls into the disposal unit 102 and is comminuted thereby. Also, during oscillation of the grid means 42 through the wiper means 46, an area of the grid means 42 adjacent the wiper means 46 is cyclically cleared of waste for allowing the passage of water therethrough.

While there has been shown and described a preferred embodiment of the present invention, it will be understood by those skilled in the art that various rearrangements and modifications may be made therein without departing from the spirit and scope of the invention.

The invention claimed is:

1. A water-waste separator comprising a trough into which mixed water and waste is introduced at one end thereof, a first opening in the bottom of said trough intermediate of the ends thereof, a second opening in the bottom of said trough at the other end thereof, a plurality of horizontal laterally spaced apart elongated grid bars overlying said first opening and accommodating the flow of water therethrough into said first opening, a stationary transverse wiper unit along the upstream side of said first opening and having a plurality of laterally spaced apart apertures, said grid bars being slidably supported in said apertures of said wiper unit, and means for oscillating said grid bars whereby waste collected thereon is cyclically forced by said wiper unit over the ends of said grid bars and is directed into said second opening.

2. A water-waste separator comprising a trough into which mixed water and waste is introduced at one end thereof, a first opening in the bottom of said trough intermediate of the ends thereof, a second opening in the bottom of said trough at the other end thereof, a plurality of horizontally laterally spaced apart elongated grid bars overlying said first opening and accommodating the flow of water therethrough into said first opening, stationary side-by-side C-shaped wiper segments along the upstream side of said first opening, said grid bars being slidably supported in said wiper segments, and means for oscillating said grid bars whereby waste collected thereon is cyclically forced by said wiper segments over the ends of said grid bars and is directed into said second opening.

3. The water-waste separator of claim 2 wherein said first and second openings are defined by an intermediate transverse web member, and the one ends of said grid bars are slidably supported on said web member.

4. The water-waste separator of claim 1 wherein said means for oscillating said grid bars comprises a generally horizontally movable L-shaped push-pull drive member having horizontal and vertical leg portions with the end of said vertical leg portion being pivotally connected to said grid bars, and drive means for effecting movement of said drive member.

5. The water-waste separator of claim 4 wherein said drive means comprises a crank arm, a connecting link pivotally connected at its one end to said crank arm and at its other end to the end of said horizontal leg portion, a reaction link pivotally connected at its one end to said end of said horizontal leg portion and at its other end to a stationary pivot point, and means for revolving said crank arm.

6. The water-waste separator of claim 1 including a reservoir tank beneath said trough, and conduit means between said first opening and said reservoir tank for conveying water from the former to the latter.

7. The water-waste separator of claim 6 including a mechanical waste disposal unit communicating with said second opening for receiving waste therefrom and comminuting the same.

* * * * *